United States Patent [19]

Sigoloff

[11] Patent Number: 4,712,314

[45] Date of Patent: Dec. 15, 1987

[54] FOOTWEAR SOLE CONSTRUCTION

[75] Inventor: Jerome A. Sigoloff, Chesterfield, Mo.

[73] Assignee: Sidney Rich Associates, Inc., St. Louis, Mo.

[21] Appl. No.: 883,049

[22] Filed: Jul. 8, 1986

[51] Int. Cl.[4] ..... A43B 3/30

[52] U.S. Cl. ..... 36/112; 36/136; 40/2 E

[58] Field of Search ..... 36/136, 132, 137, 130, 36/25 R, 30 R, 98, 112; D2/317, 321; 40/2 E, 454; 2/245

[56] References Cited

U.S. PATENT DOCUMENTS

| | | | |
|---|---|---|---|
| D. 80,001 | 11/1929 | Wydom | D2/321 |
| D. 86,921 | 5/1932 | Mason | D2/321 |
| D. 253,797 | 1/1980 | Wechsler | D2/321 |
| 1,989,553 | 1/1935 | Kanolt | 40/454 |
| 2,720,713 | 10/1955 | Schwartz et al. | 40/2 E |
| 3,027,661 | 4/1962 | McCord | 36/30 R |
| 3,075,305 | 1/1963 | Shapiro et al. | 36/112 |
| 3,082,556 | 3/1963 | Schwartz et al. | 40/2 E |
| 3,195,244 | 7/1965 | Whitcas | 36/130 |
| 4,050,167 | 9/1977 | Senter | 36/112 |
| 4,233,760 | 11/1980 | Haynes | 36/137 |

FOREIGN PATENT DOCUMENTS

| | | | |
|---|---|---|---|
| 2454899 | 12/1980 | France | 36/136 |
| 584291 | 1/1947 | United Kingdom | 40/2 E |

*Primary Examiner*—Henry S. Jaudon
*Assistant Examiner*—Steven N. Meyers
*Attorney, Agent, or Firm*—Jay H. Maioli

[57] ABSTRACT

A footwear sole has an outer ply with at least one aperture formed therein. A transparent insert backed with a lenticular element having a distinctive figure and/or text illustrated thereon is mounted within the aperture and behind the transparent insert. At least one inner ply is affixed to the outer ply to secure the insert in place, as well as to provide cushioning and support for a user's foot.

7 Claims, 4 Drawing Figures

FOOTWEAR SOLE CONSTRUCTION

BACKGROUND OF THE INVENTION

1. Field of the Invention

This invention relates to an article of footwear, and more particularly to a sole constructed with decorative inserts.

2. Description of the Background

It is known in the prior art to provide decorations, embossed figures, and the like on the outer surface of soles for footwear. Some examples of such decoration are found in U.S. Pat. Nos. Des. 253,797; 86,921; and 80,001. These designs are generally worn off or degraded quickly after use of the footwear.

Other patents disclose the construction of various types of inserts within the sole of a shoe. For example, U.S. Pat. No. 4,050,167 discloses the insertion of a three-dimensional inset figure in a recessed area of the sole. While this patent provides the inset figure so as to be substantially flush with the walking surface of the sole, it has the disadvantage of the design wearing off and being obscured by mud and dirt. U.S. Pat. No. 3,075,305, suggests embedding anti-skid plugs within the soles of infants' shoes and, similarly, U.S. Pat. No. 3,195,244, shows the insertion of fluorocarbon plugs in recesses in the sole of a bowling shoe. These plugs, however, provide little or no decorative effect.

Thus, there is a need for a footwear sole that has some decorative effect, especially for children, yet in which the decoration does not wear off easily and is not easily obscured by mud and dirt.

OBJECTS AND SUMMARY OF THE INVENTION

Accordingly, it is an object of the present invention to provide a footwear sole construction that can eliminate the above-noted defects inherent in the prior art.

Another object of this invention is to provide a footwear sole construction in which a decorative insert is protected by a clear plastic element.

A further object of this invention is to provide a footwear sole construction in which a decorative insert is formed from a lenticular element to provide apparent movement of a figure or text included in the insert.

Still another object of the present invention is to provide such a footwear sole wherein lenticular backed inserts or three-dimensional opaque inserts having distinctive figures and/or text formed therein, may be selectively mounted, alone or in combination, within a single type of outer surface ply of the sole.

In accordance with an aspect of the present invention, there is provided an improved footwear sole construction wherein the sole has at least one inner ply and an outer ply. The outer ply has an aperture formed therein and a peripheral recess about the aperture formed within its inner surface, and a transparent insert has a peripheral flange which is seated within the recess in the outer ply. The transparent insert is substantially coplanar with the outer ply's inner surface and is slightly recessed relative to its outer sole surface. A lenticular element having a distinctive picture printed thereon is mounted on the upper surface of the transparent insert. The lenticular element and transparent insert are locked in place when the inner ply is affixed to the outer ply.

The above and other objects, features, and advantages of the present invention will become apparent from the following detailed description of illustrative embodiments thereof to be read in conjunction with the accompanying drawings, in which like reference numerals represent the same or similar elements.

BRIEF DESCRIPTION OF THE DRAWINGS

Referring now to the drawings, FIG. 1 illustrates an article of footwear 6 formed of an upper 8 and a sole portion 10. The sole portion 10 is an assembly that includes an outer ply 12, and the construction of this assembly is illustrated more clearly in the sectional view of FIG. 2. The decorative and inventive insert assembly is shown generally at 11 and can assume any desired outline. In addition, more than one insert 11 can be provided in each sole 10. Also, outer sole 12 can be textured with a design complementary to the picture appearing in the insert 11 if desired, without departing from the intent of the present invention.

As seen in FIG. 2, a first inner ply 14 and a second inner ply 16 form the principal structure of sole 10, along with outer ply 12. An inner liner layer 17 is provided to be adjacent the wearer's foot during use. An aperture 18 is formed within outer ply 12, and it is in this aperture that the decorative insert assembly 11 according to the present invention is arranged.

Figure 1:
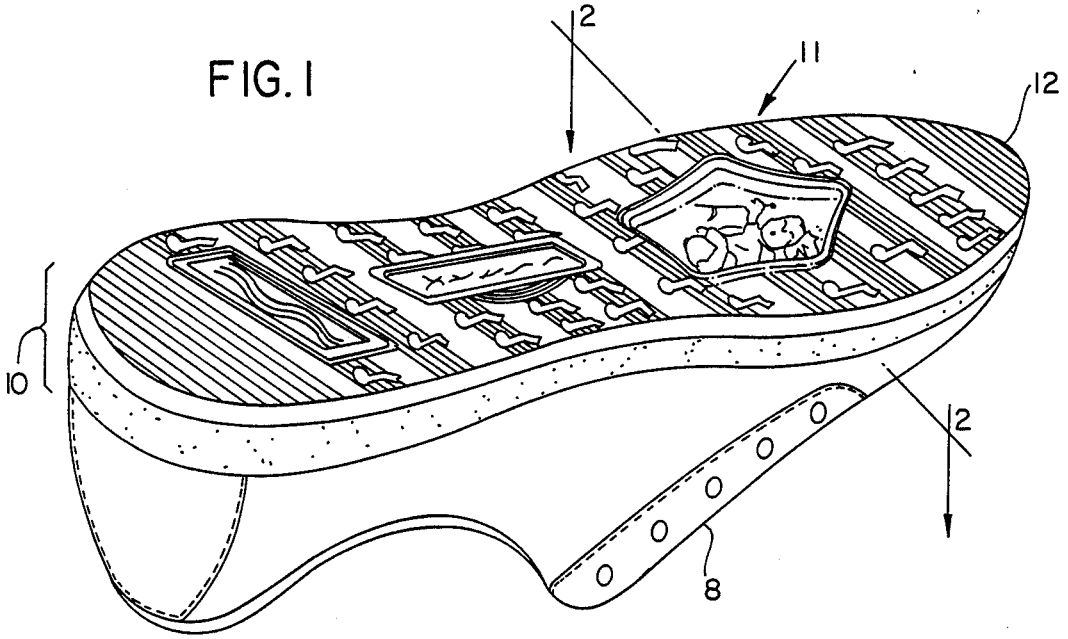
FIG. 1 is a perspective showing the bottom surface of the sole of an article of footwear, incorporating a lenticular backed, transparent insert according to the present invention.
Figure 3:
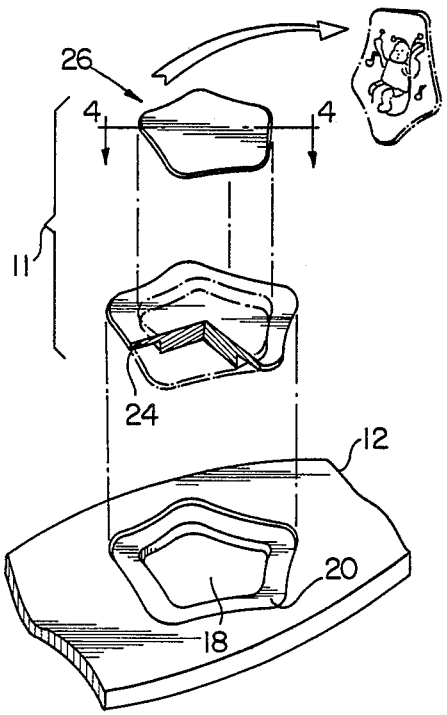
FIG. 3 is an exploded perspective, showing the assembly of the lenticular backed, transparent insert relative to the outer ply of the footwear sole.

As shown more clearly in the exploded view of FIG. 3, a peripheral recess 20 is formed about aperture 18 on the inside surface of outer ply 12. The outer ply 12, which provides the walking surface of the shoe 6, is preferably molded from any of the flexible rubber-like materials that are well known for such use, and aperture 18 and peripheral recess 20 may be formed at the time of molding outer ply 12. Outer ply 12 is also formed with a tread design, shown generally at 21, which may be decorative or not. The inner plies 14, 16 are generally formed of a softer material than that of outer ply 12 and function to provide both cushioning and support for a user's foot in the known fashion.

Figure 4:
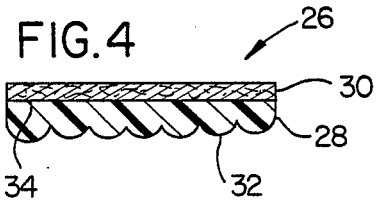
FIG. 4 is a transverse cross section of the lenticular element taken along section lines 4—4 of FIG. 3.
Figure 2:
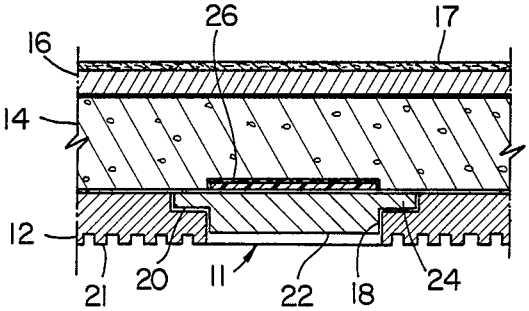
FIG. 2 is a transverse sectional view of the inventive sole taken along section lines 2—2 of FIG. 1.

Referring still to FIG. 3, insert assembly 11 is formed of a transparent insert 22 is provided with a peripheral flange 24, and the circumferential contour of the lower portion of transparent insert 22 is formed to mate with the corresponding contour of aperture 18. Similarly, the circumferential contour of peripheral flange 24 is formed to fit securely within peripheral recess 20. The depth of recess 20 is formed to accommodate the thickness of flange 24. Transparent insert 22 is formed of a clear, flexible, plastic material, preferably a PVC or the like and may some tint to achieve color coordination. The lenticular insert assembly 26 is provided to display a distinctive figure and/or text, and the construction of this assembly is shown in FIG. 4. Lenticular assembly 26 is affixed to the back surface of transparent insert 22.

Referring then to FIG. 4, the lenticular insert 26 is shown by formed of a transparent, multifaceted, plastic element 28 that is firmly mated with a paper element 30 bearing the picture or text for ultimate display on the sole of the footwear. The construction of such a lenticular assembly is well known and, as such, forms no part of this invention apart from its combination with the footwear sole. Nevertheless, it should be noted that when in use, the light passing through the plurality of lenses, one of which is shown generally at 32, of element 28 will cause apparent motion of an image residing on an inner surface 34 of paper element 30.

When assembled, the lenticular element 28 of insert assembly 26 is fixed to the upper or inner surface of transparent insert 22 with a suitable adhesive, not shown, or is thermally bonded thereto. Transparent insert 22 is then mounted within aperture 18 so that flange 24 is seated within recess 20 and may be fixed thereat with a suitable adhesive. The upper surface of transparent insert 22 is substantially coplanar with the inner surface of outer ply 12 and the entire insert assembly 11 is retained by inner ply 14. The lower surface of transparent insert 22 lies slightly recessed relative to the contact surface of outer ply 12. In fact, the outer surface of transparent insert 22 can be substantially coplanar with a plane defined by the inner surface of the tread design on the sole. It is preferable that transparent insert 22 be recessed within or at least coplanar with the lower surface of outer ply 12, so that a user's foot is not subjected to greater stress along the surface areas of the insert.

The first inner ply 14 and second inner ply 16 are substantially aligned and fixed on top of one another with a suitable adhesive, not shown. The assembled plies are then aligned on top of outer ply 12 and fixed thereon, again with a suitable adhesive. Thereafter, transparent insert 22 and lenticular insert 26 forming assembly 11 are securely locked in place between outer ply 12 and first inner ply 14.

It will be understood that transparent insert 22, lenticular insert 26, and aperture 18 may be formed in a variety of cooperating shapes and sizes, which are essentially limited only by the overall size of footwear 6. Similarly, aperture 18 may be formed at any preferred location on the face of outer ply 12. Further, if desired, more than one aperture and cooperating transparent insert may be easily incorporated within a single sole assembly.

Another embodiment is contemplated by the present invention wherein transparent insert 22 and lenticular insert 26, as set forth in the previous embodiment, are replaced with a three-dimensional opaque insert, which may have a distinctive figure and/or text formed thereon. All other elements of that embodiment would remain unchanged from the previous embodiment. In this further embodiment the lower face of transparent insert 22 would be molded into any desired three-dimensional configuration, such as a popular comic figure or logo, and colored accordingly. As with the transparent insert 22, the opaque insert may be arranged at any desired location on the face of outer ply 12. Similarly, if desired, more than one opaque insert, each of varying configuration, may be incorporated within a single sole assembly.

Although a primary novel feature of the present invention is the incorporation of a lenticular backed, transparent insert within the outer ply of the sole assembly, a further advantage is that a manufacturer may mold a single outer ply 12 to accept either lenticular inserts, opaque inserts, or a combination of both. Transparent insert 22 and the opaque insert (not shown) may be formed with flanges having substantially similarly peripheral contours. Thereafter, a manufacturer may selectively incorporate, alone or in combination, various inserts displaying new, more popular figures and/or text within an existing outer ply design.

While preferred embodiments of the invention have been described and illustrated, it is understood that variations and modifications may be made thereof without departing from the spirit of the invention, the scope of which is to be determined only by the appended claims.

What is claimed is:

1. A footwear sole, comprising:

at least one inner ply and an outer ply adapted for mutual contact;

said outer ply having at least one aperture formed therein and a peripheral recess formed about said aperture on a surface adjacent said inner ply;

a transparent insert element mounted within said aperture formed in said outer ply and including a peripheral flange adapted to cooperate with said recess, thereby seating said transparent insert element within said aperture in said outer ply and wherein said transparent insert element is formed having a thickness so as to be recessed relative to an outer sole surface of said outer ply upon said seating of said transparent insert element in said outer ply; and a lenticular insert element including an illustration formed therewith arranged between said transparent insert element and said inner ply, whereby said illustration is viewed through only said lenticular insert and said transparent insert element.

2. A footwear sole according to claim 1; wherein said illustration is a cartoon character.

3. A footwear sole, comprising:

at least one inner ply and an outer ply, superimposed one upon the other;

said outer ply having at least one aperture formed therein and having a peripheral recess about said aperture in a surface thereof adjacent said inner ply;

and a lenticular assembly having a figure formed therein and having a peripheral flange for seating said lenticular assembly within said peripheral recess, such that an upper surface of said lenticular assembly is substantially coplanar with said surface of said outer ply adjacent said inner ply and a lower surface of said lenticular assembly is recessed relative to an outer sole surface of said outer ply.

4. A footwear sole, comprising:

an outer ply adapted for lamination to an inner ply;

an aperture formed in an outer contact surface of said outer ply; and a lenticular assembly affixed within said aperture and a lower surface of said lenticular assembly being recessed relative to said outer contact surface, said lenticular assembly including a pictorial element arranged adjacent a lenticular element, whereby said pictorial element is visible in said aperture through said lenticular element.

5. A footwear sole according to claim 4, further comprising a transparent element arranged adjacent said lenticular assembly in said aperture for viewing said lenticular assembly therethrough and being recessed relative to said outer contact surface.

6. A footwear sole according to claim 4; wherein a recess is formed in said outer ply around the periphery of said aperture in a surface of said outer ply adjacent said inner ply, and said lenticular element further includes a peripherial flange element adapted to reside in said recess.

7. A footwear sole according to claim 4; wherein said pictorial element comprises a printed paper element bearing a representation of a cartoon character.

* * * * *